US006746340B1

(12) United States Patent
Dover

(10) Patent No.: US 6,746,340 B1
(45) Date of Patent: Jun. 8, 2004

(54) GOLF DIVOT PRACTICE MAT

(76) Inventor: Robert L. Dover, 1208 Meridan Bay Dr., Las Vegas, NV (US) 89128

( * ) Notice: Subject to any disclaimer, the term of this patent is extended or adjusted under 35 U.S.C. 154(b) by 0 days.

(21) Appl. No.: 10/277,540

(22) Filed: Oct. 22, 2002

Related U.S. Application Data

(60) Provisional application No. 60/342,891, filed on Oct. 22, 2001.

(51) Int. Cl.[7] ..... A63B 69/36
(52) U.S. Cl. ..... 473/278
(58) Field of Search ..... 473/278, 279

(56) References Cited

U.S. PATENT DOCUMENTS

| | | | | | |
|---|---|---|---|---|---|
| 2,790,640 | A | * | 4/1957 | Hoag | 473/278 |
| 3,348,847 | A | * | 10/1967 | Fischl | 473/262 |
| 4,130,283 | A | * | 12/1978 | Lindquist | 473/262 |
| 4,312,504 | A | * | 1/1982 | Rutledge et al. | 472/92 |
| D275,413 | S | * | 9/1984 | Shroads et al. | D21/792 |
| 4,850,594 | A | * | 7/1989 | Manzione | 473/162 |
| 5,004,243 | A | * | 4/1991 | Dlouhy | 473/279 |
| 5,028,052 | A | * | 7/1991 | Miller | 473/278 |
| D338,701 | S | * | 8/1993 | Weber | D21/792 |
| 5,292,130 | A | * | 3/1994 | Hooper | 473/279 |
| 5,293,660 | A | * | 3/1994 | Park | 15/160 |
| 5,333,875 | A | * | 8/1994 | Wilson | 473/262 |
| 5,443,870 | A | * | 8/1995 | Lurie et al. | 428/17 |
| 5,590,882 | A | * | 1/1997 | Todd | 473/218 |
| 5,630,719 | A | * | 5/1997 | Franklin | 434/252 |
| 5,888,147 | A | | 3/1999 | Luedtke | |
| 6,155,931 | A | * | 12/2000 | Perrine | 473/278 |
| 6,156,396 | A | * | 12/2000 | Florian | 428/17 |
| 6,569,027 | B2 | * | 5/2003 | Florian | 473/160 |
| 6,585,604 | B1 | * | 7/2003 | Morrone | 473/237 |
| 6,616,542 | B1 | * | 9/2003 | Reddick | 473/171 |

* cited by examiner

*Primary Examiner*—Gregory Vidovich
*Assistant Examiner*—Nini F. Legesse
(74) *Attorney, Agent, or Firm*—Rob L. Phillips; Quirk & Tratos

(57) ABSTRACT

An artificial turf golf practice mat has a removable rectangular divot patch sized about four inches wide to simulate a real dirt divot on a fairway. The forward end of the pivot patch is anchored to the rubber base by some means such as a hook and loop, a clamp, or a permanent attachment to the artificial grass top layer. In action the divot patch is propelled away from the mat along with the ball to simulate various shots. A pair of alignment lines help the golfer position his feet and provide a putting exercise. A base for a tee is provided to allow practicing driving shots.

18 Claims, 5 Drawing Sheets

GOLF DIVOT PRACTICE MAT

CROSS REFERENCE APPLICATIONS

This application is a non-provisional application claiming the benefits of provisional application No. 60/342,891 filed Oct. 22, 2001.

FIELD OF INVENTION

The present invention relates to providing an artificial turf golf practice mat with a mat segment that simulates a divot when the ball is hit properly.

BACKGROUND OF THE INVENTION

Known in the art are artificial turf golf practice mats. They are generally about four feet wide and five feet long. A golfer can get the feel of hitting a grass-like surface with various clubs. This type of mat is fine for practicing putting and other strokes. There is no "give" in these mats which can cause injury to the forward shoulder, elbow or wrists after continuous use. Also, a descending blow under and through the ball cannot be achieved because the club bounces off the mat upon impact. Many shots on the fairway require creating a divot to properly hit the ball. The club should first contact the ball, and then drive under the ball to tear up a rectangular section of turf. In a short sand shot, the club hits the sand, and then the sand propels the ball forward.

The present invention simulates both the fairway divot shot and the short sand shot by providing a rectangular removable artificial turf segment (divot patch) on the golf practice mat. A hook and loop fastener at the far end of the divot patch holds the divot patch onto the golf practice mat after the shot to enable the golfer to smooth out the divot patch and try another swing.

SUMMARY OF THE INVENTION

The primary aspect of the present invention is to provide a golf practice mat with a removable patch which simulates a dirt divot on the fairway.

Another aspect of the present invention is to provide a hook and loop fastener under a forward portion of the removable patch to simplify retrieval after the practice shot.

Another aspect of the present invention is to provide a shaved portion of artificial grass on the mat to hold the golf ball when the mat is placed on an angle.

Another aspect of the present invention is to provide a rubber mount flush with the artificial grass to hold a tee for practicing driving shots.

Another aspect of the present invention is to provide a pair of alignment lines on the mat to help the golfer align his feet and to practice putting in a straight line between the pairs of adjacent lines.

Other aspects of this invention will appear from the following description and appended claims, reference being made to the accompanying drawings forming a part of this specification wherein like reference characters designate corresponding parts in the several views.

The present invention is rubber based with an Astroturf® top or other artificial grass surface. The golfer stands on the mat. He may use any of his clubs to begin practice. The mat has the portability to use in the garage, backyard or driving range with "whiffle balls" or golf balls.

A 4 inch by 16 inch mat piece (divot) is inlaid into the upper left side (forward end) of the mat. This divot is attached to the mat with a hook and loop fastener such as Velcro® on the forward portion of the divot inlay. To practice, a ball (real or plastic) is placed just behind the divot inlay. When the ball is struck properly, the divot will lift up, giving the feel of a grass divot on the fairway. The divot is set back down to its original position, ready for the next practice shot. A "proper" stroke is defined as one in which the club head face strikes the ball before contacting the ground. This is what the present invention mat will teach with practice. An improper hit, topped or where club hits the ground prior to hitting the ball, will not move the divot inlay. Due to the "give" of the divot, the inlay reduces impact shock often encountered with irons on regular mats.

A pair of white stripes are painted on the mat for two purposes: 1) It is a guide to validate a straight putter face during the entire putting stroke for putting between the lines, 2) It serves to aid proper alignment of feet and shoulders for divot shots.

Equivalents to the stripes include a divider or pair of dividers protruding up or down from the artificial turf.

Although unlikely, if the divot is damaged in any way, it can easily be removed and replaced with another.

The mat comes with a hole punched for a rubber base for a tee to be used for driving or other long distance shots.

For practice on angled surfaces, a shaved portion of the artificial turf prevents the ball from rolling.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
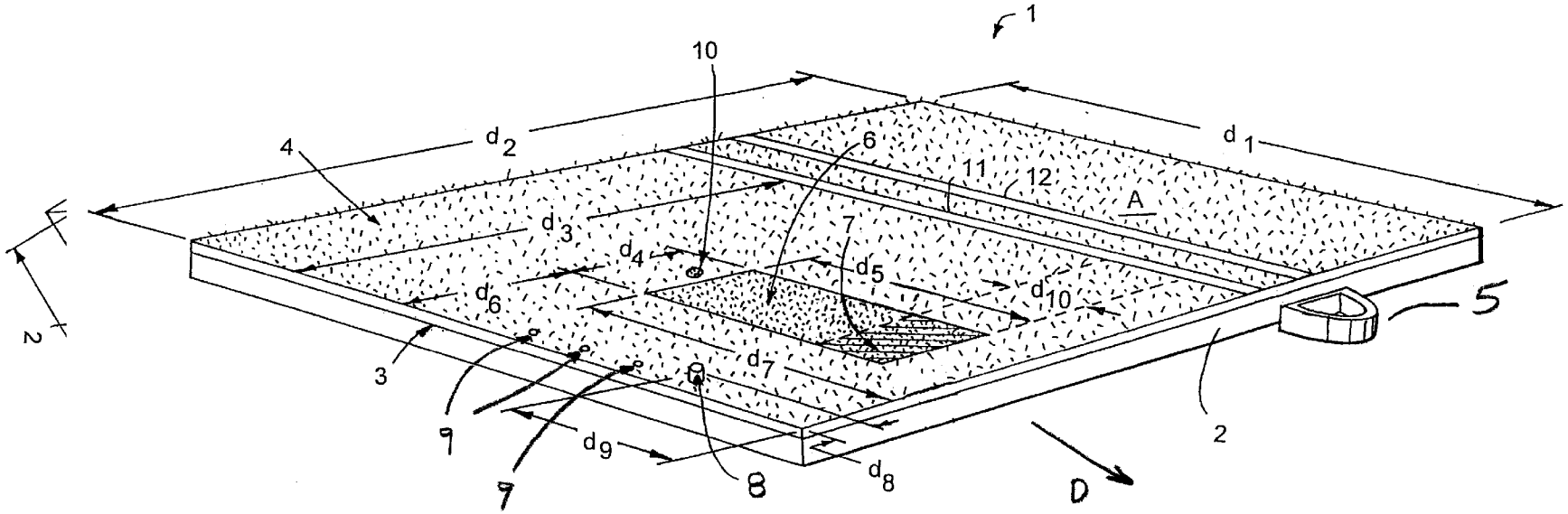
FIG. 1 is a top perspective view of the preferred embodiment, a golf divot practice mat.

Referring first to FIG. 1 the golf divot practice mat 1 comprises a rubber base 2 about ⅝ inch thick. Glue 3 is applied to the base 2 to secure an artificial turf layer 4.

Preferably stripes 11, 12 are painted white lines about four inches apart. For divot shots the golfer stands in area A, using the stripes 11, 12 to align his feet. For putting practice the golfer can stand on or off the mat I to practice hitting straight putts between the stripes 11, 12 into a cup 5. Equivalents to stripes 11, 12 include a divider across the mat, ruts in the mat or protrusions of the base through the artificial turf layer 4.

For divot shot practice the golfer places the ball on shaved grass dimple 10 and stands in area A. The divot patch 6 is rectangular as shown which simulates the shape of a real dirt divot. The forward section 7 of the divot patch 6 is about four inches square. An under surface of forward section 7 is a first hook and loop member, and a top surface of the rubber base 2 is a second hook and loop member. Thus, when the divot patch 6 is hit in direction D the forward section 7 prevents the entire divot patch 6 from flying off the mat 1.

| Nominal dimensions are: | |
|---|---|
| d1 | 4' |
| d2 | 5' |
| d3 | 2'7" |
| d4 | 4" |
| d5 | 16" |
| d6 | 10" |
| d7 | 2' |
| d8 | 5" |
| d9 | 1' |
| d10 | 4" |

A rubber tee 8 permits fairway drives to be practiced. An optional series of tee holders 9 are flush with the top surface of the grass of turf layer 4. Each tee holder 9 comprises a hole for receipt of a tee for further driving practice.

Figure 2:
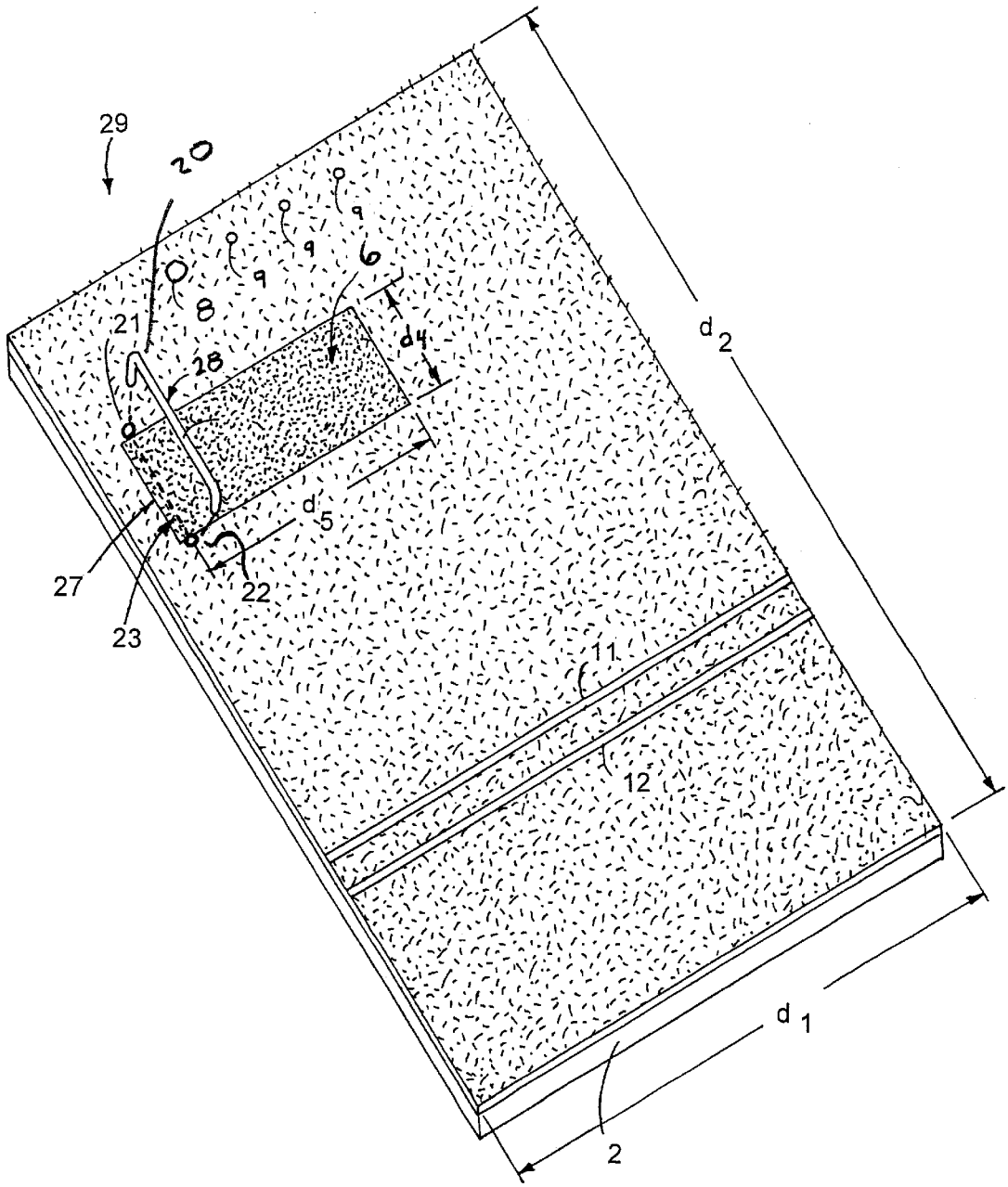
FIG. 2 is a top perspective view of an alternate embodiment.
Figure 3A:
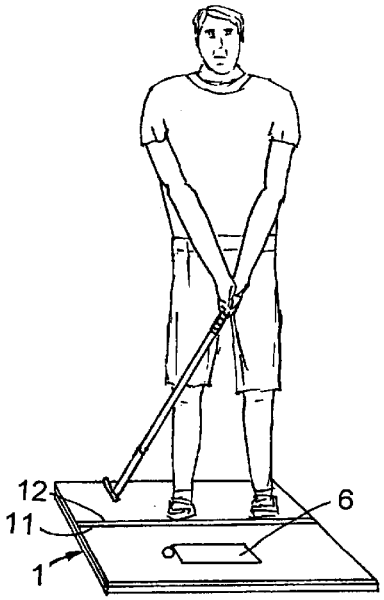
FIGS. 3*a*–3*d* are a series of top perspective views of a golfer properly executing a divot shot.
Figure 3B:
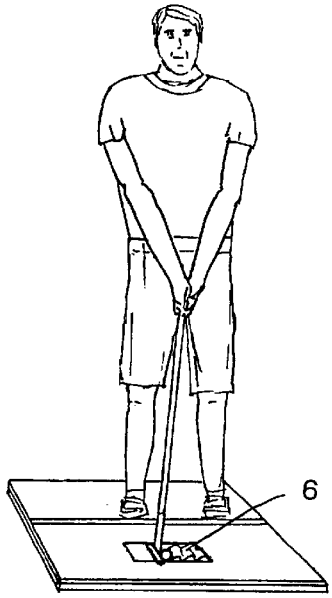
Figure 3C:
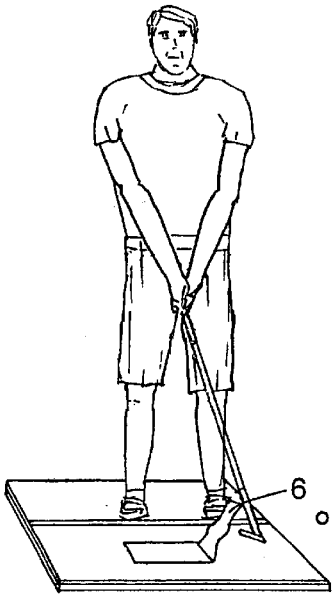
Figure 3D:
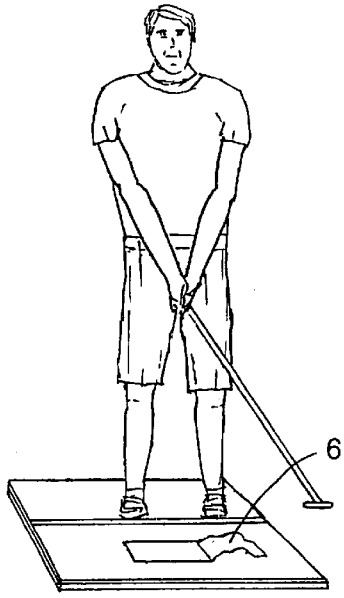
Figure 4A:
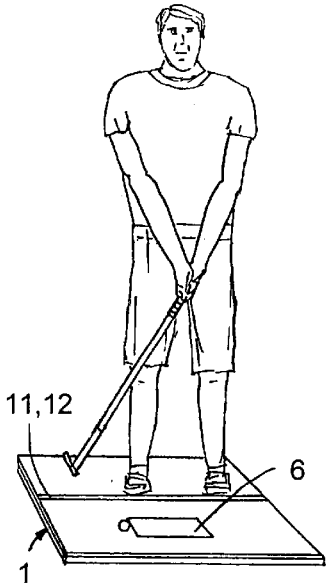
FIGS. 4*a*–4*e* are a series of top perspective views of a golfer improperly executing a divot shot.
Figure 4B:
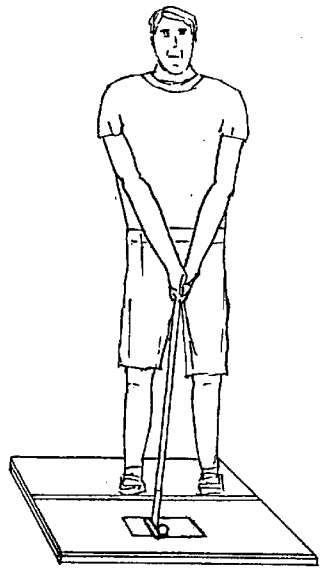
Figure 4C:
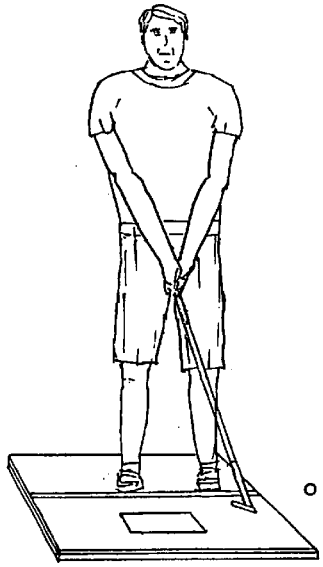
Figure 4D:
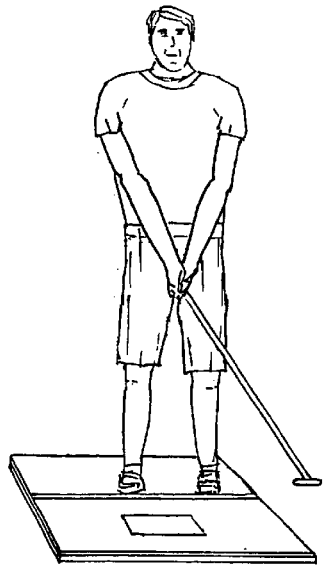
Figure 4E:
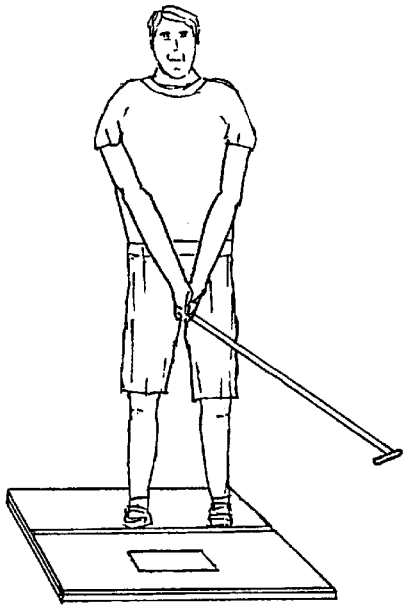

Referring next to FIG. 2 an alternate embodiment divot practice mat 29 is shown with the overall appearance and size very similar to the preferred embodiment. The key difference is the elimination of the hook and loop fasteners from the preferred embodiment. A U-shaped claim 20 can be made of metal or plastic. Holes 21, 22 in the base 2 receive the ends of the clamp 20. The elongate portion 28 of clamp 20 holds down the forward edge 27 of the divot patch 22, thus leaving about a one-inch segment 23 pinned down to the base 2 during a shot. Not shown is another alternate embodiment where the forward edge of the divot patch is a continuation of the turf layer 4.

Referring next to FIGS. 3*a*–3*d* the golfer is shown starting a swing with the ball on spot 10. The head of the club strikes the ball first, then hits the mat 1 below the ball, thereby creating a divot with the pivot patch 6.

After the shot the golfer flattens out the divot patch 6.

Referring next to FIGS. 4*a*–4*e* the golfer again starts with the ball on spot 10. However, if the club strikes the ball first, or tops the ball, then the divot patch 6 remains in place.

Figure 5A:
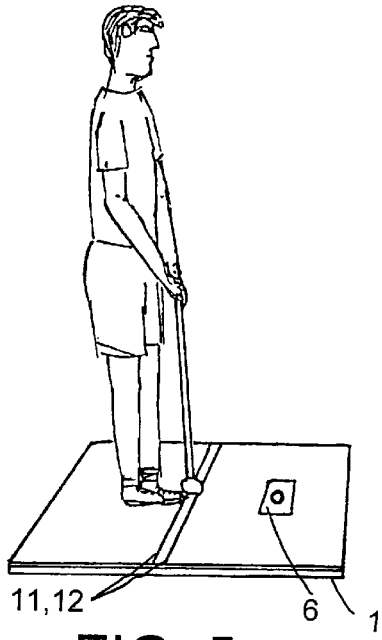
FIGS. 5*a*–5*c* are a series of top perspective views of a golfer properly executing a short sand shot where the divot patch propels the golf ball forward.
Figure 5B:
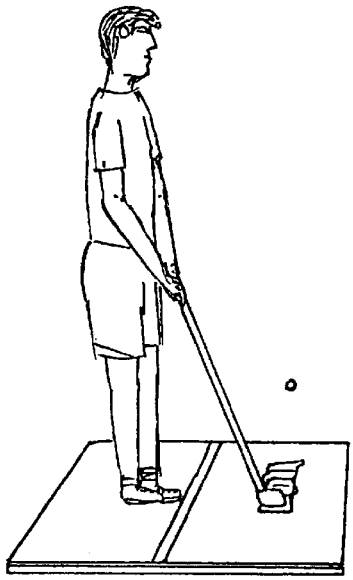
Figure 5C:
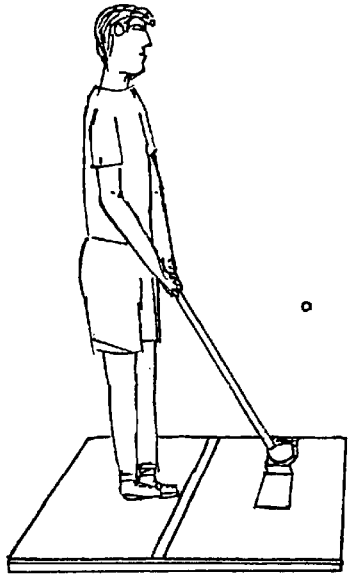

Referring next to FIGS. 5*a*–5*c* the golfer starts with the ball near the center of the divot patch 6. In simulating a short sand shot, the golfer hits the divot patch 6 first, wherein the divot patch 6 then propels the ball onto the green (hopefully).

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A golf practice mat comprising:

an artificial grass top layer supported by a base member; and an elongated divot patch incorporated within the top layer, said divot patch having a rear edge disjoined from said top layer and a left edge and right edge having at least a portion of their length, proximate said rear edge, disjoined from said top layer and a front edge removably secured to the top layer or base member by securing means thereby allowing a golf club to strike the rear edge of the divot patch causing the rear edge of the divot patch to propel away from the top layer and the base member while said front edge maintains its original removably secured position thereby preventing the entire divot patch from separating from the top layer or base member.

2. The golf practice mat of claim 1 further comprising a base for supporting said artificial grass top layer.

3. The golf practice mat of claim 1 wherein said front edge is secured to said top layer or base member by means of hook and loop fasteners.

4. The golf practice mat of claim 1 wherein said front edge is secured to the top layer or base member by means of a clamping device secured to said mat.

5. The golf practice mat of claim 1 further comprising a pair of elongated parallel markings for practicing putts and proper alignment.

6. The golf practice mat of claim 1 further comprising a depression located adjacent the rear edge of the divot patch, said depression sized to accommodate a golf ball.

7. The golf practice mat of claim 1 further comprising one or more integrated golf tees.

8. The golf practice mat of claim 1 further comprising one or more apertures for receiving and supporting individual golf tees.

9. A golf practice mat comprising:

a base large enough to accommodate a golfer;

an artificial turf top layer surface supported by said base;

a pair of parallel elongated alignment markings on said top layer, said markings for separating a player support area and divot patch area; and an elongated divot patch incorporated within the grass top layer, said divot patch including a removable portion of the top layer, said removable portion having a front segment joined to the top layer or base by means of hook and loop fasteners thereby allowing a golf club to strike a rear portion of the divot patch causing the rear portion of the divot patch to propel away from the top layer and the base while said front segment maintains its original secured position thereby preventing the entire divot patch from separating from the top layer or base.

10. The golf practice mat of claim 9 further comprising a depression located adjacent the rear segment of the divot patch, said depression sized to accommodate a golf ball.

11. The golf practice mat of claim claim 9 further comprising incorporating one or more golf tees.

12. The golf practice mat of claim claim 9 further comprising one or more positions for inserting a golf tee.

13. A golf practice mat comprising:

a base means approximately four feet wide and five feet long which functions to support a golfer and golf ball;

an artificial turf means atop the base means; and an elongated divot patch means integrated within the artificial turf means said divot patch means including a removable portion of the top layer, said removable portion having a front segment removably joined to the top layer or base by securing means thereby allowing a golf club to strike a rear portion of the divot patch means causing the rear portion of the divot patch to propel away from the top layer and the base by securing means while said front segment maintains its original removably secured position thereby preventing the entire divot patch from separating from the top layer or base.

14. The golf practice mat of claim 13 wherein said divot patch means maintains its original position by means of hook and loop fasteners.

15. The golf practice mat of claim 13 wherein said divot patch means maintains its original position by means of a clamping device.

16. The golf practice mat of claim 13 further comprising a pair of elongated parallel markings for providing player alignment.

17. The golf practice mat of claim 13 further comprising a depression located adjacent a rear edge of the divot patch, said depression sized to accommodate a golf ball.

18. A method of training golfers comprising:

providing a base supporting an artificial grass top layer;

providing an elongated divot patch incorporated within said grass top layer wherein a front portion of said divot patch is removably secured to said top layer or base thereby allowing a golf club to strike a rear portion of the divot patch causing the rear portion of the divot patch to propel away from the top layer and the base by securing means while said front segment maintains its original secured position thereby preventing the entire divot patch from separating from the top layer or base;

providing an indent proximate a rear portion of said divot patch for holding a golf ball; and providing a base position for a golfer to stand and swing a golf club.

* * * * *